United States Patent [19]

Walsh

[11] Patent Number: 4,971,586

[45] Date of Patent: Nov. 20, 1990

[54] SMALL-SIZED SELF-PROPELLED WATERCRAFT

[76] Inventor: Kevin M. Walsh, 157 Conlyn Ave., Franklin, Mass. 02038

[21] Appl. No.: 374,646

[22] Filed: Jun. 30, 1989

[51] Int. Cl.[5] ..... B63B 35/72

[52] U.S. Cl. ..... 440/88; 123/585; 114/270; 440/1

[58] Field of Search ..... 440/113, 88, 89, 38, 440/1; 123/568, 569, 585, 198 D; 441/74; 114/270

[56] References Cited

U.S. PATENT DOCUMENTS 3,262,413 7/1966 Douglas et al. ..... 440/46
3,548,778 12/1970 Von Smagala-Romanoff ..... 440/85
3,807,373 4/1974 Chen ..... 123/434
4,494,488 1/1985 Wheatley ..... 123/585

*Primary Examiner*—Sherman Basinger
*Assistant Examiner*—Edwin L. Swinehart

[57] ABSTRACT

A self-propelled portable watercraft, including a deck and hull, an engine, and a waterjet propulsion system, capable of operating while a supply of air is unavailable. The air substitute, consisting of a mixture of oxidizing gas and recycled exhaust gas, is delivered to the engine through a self-actuated control valve. In addition, the waterjet propulsion system is equipped with an intake port at the terminus of a narrow, elongated, hollow downward extension of the hull. The purpose of the extension being to minimize the occurrence of a loss of thrust which can result when the craft is vertically displaced above the surface of the surrounding water.

7 Claims, 4 Drawing Sheets

FIG-4
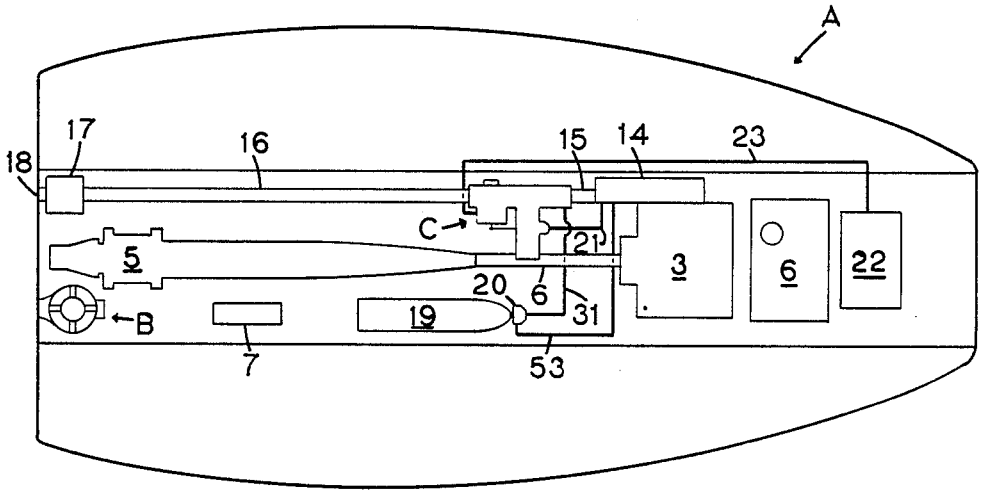
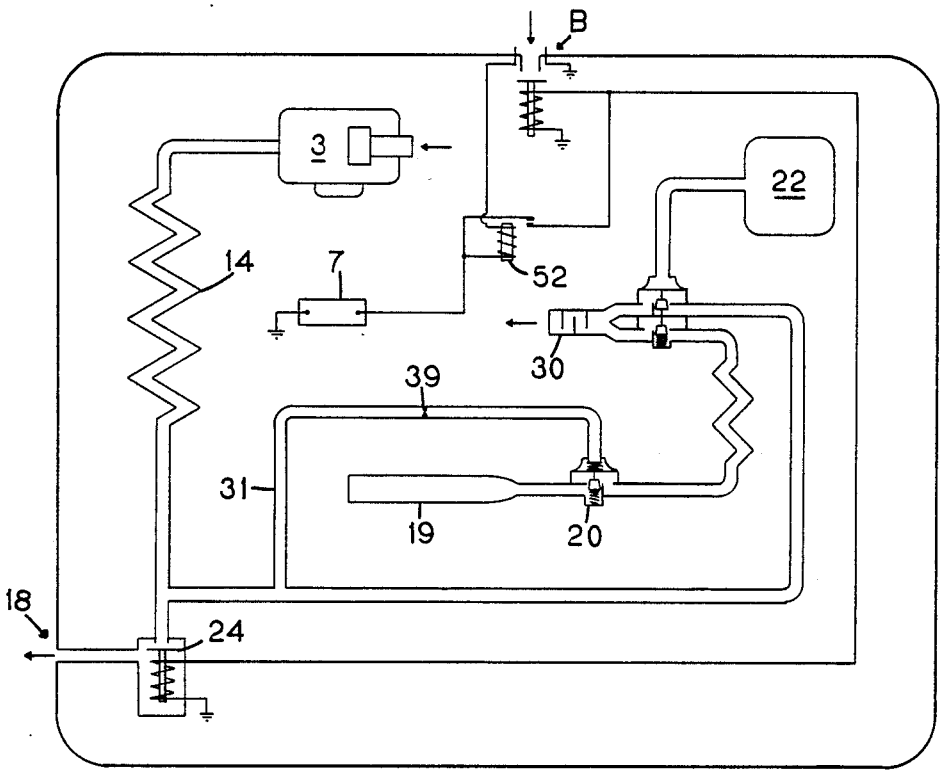
FIG-5

FIG-8
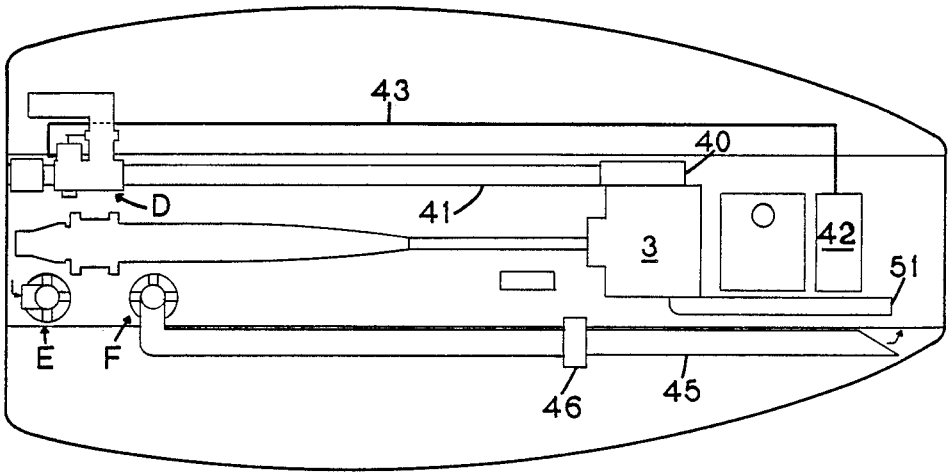
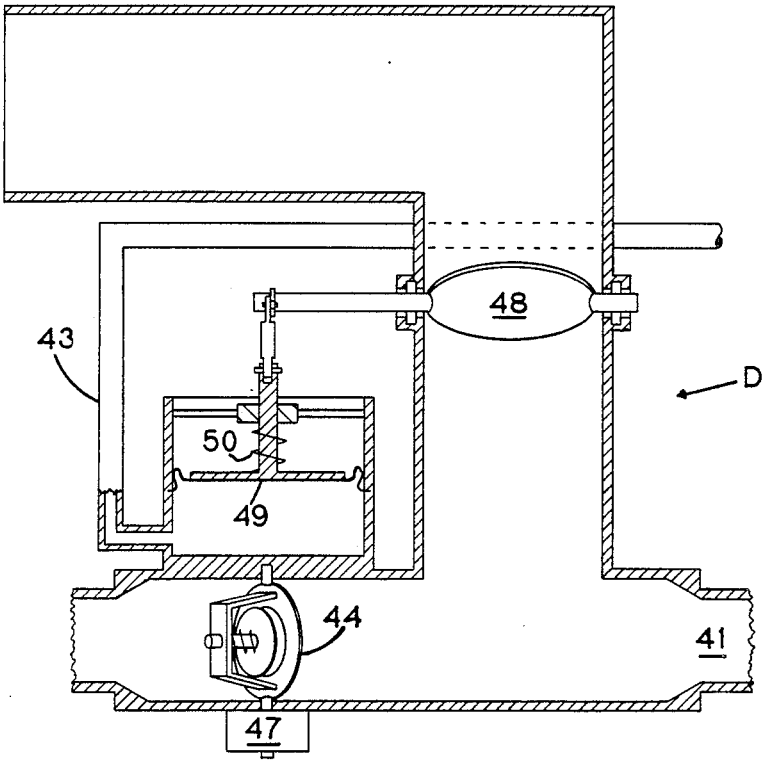
FIG-9

SMALL-SIZED SELF-PROPELLED WATERCRAFT

BACKGROUND OF THE INVENTION

This invention relates to watercraft and more particularly relates to a self-propelled surboard type craft.

Several small, lightweight watercraft, often called "motorized surfboards", have been devised and used in the past. In general, most simply involve the installation of an engine on a surfboard type craft and this engine is ordinarily mounted within the interior of the craft. To allow the engine to breathe, an opening or air intake duct must be provided. If the craft is small and has a low profile, this opening must be close to the surrounding water, which can result in flooding if the craft were partially or completely submerged. Although some previous designs provide a closable valve or other device to exclude water, a means for the engine to breathe while the craft is submerged would be desirable. Such a means in combination with a closable air intake port would eliminate flooding and engine stalling and would allow the craft to be operated in nearly all surf conditions.

Small watercraft generally also incorporate a water-jet propulsion system. The intake port for the water-jet is conventionally an opening located on a central portion of the hull. This can be disadvantageous. The light weight of the watercraft results in a comparatively shallow draft. Consequently, the water intake port is relatively close to the surface of the water. Small vertical displacements, for instance those caused by waves, can momentarily raise the intake port above the surface of the water, with a subsequent loss of forward thrust.

Accordingly, it is a primary object of this invention to provide a watercraft which is small, lightweight and fast.

It is another object of the invention to provide a means for the engine of such a craft to run while it has no access to a supply of air.

It is a further object of the invention to provide a water-jet propulsion system for such a craft, which is less susceptible to a loss of forward thrust due to small vertical displacements.

BRIEF DESCRIPTION OF THE DRAWINGS

FIG. 4 is a top plan view, with cover removed, showing the layout of the major components;

FIG. 5 is a schematic diagram of the craft's gas supply system;

FIG. 8 is a top plan view of a second embodiment of the watercraft, with cover removed, showing the layout of the major components; and FIG. 9 is a cross-sectional view of a valve assembly of the second embodiment which, on demand, can supply exhaust gas to the interior of the craft.

DESCRIPTION OF THE PREFERRED EMBODIMENT

Figure 1:
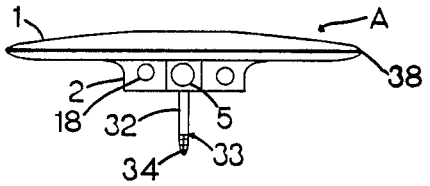
FIG. 1 is a rear elevational view of an embodiment of a small-sized watercraft in accordance with the invention.
Figure 2:
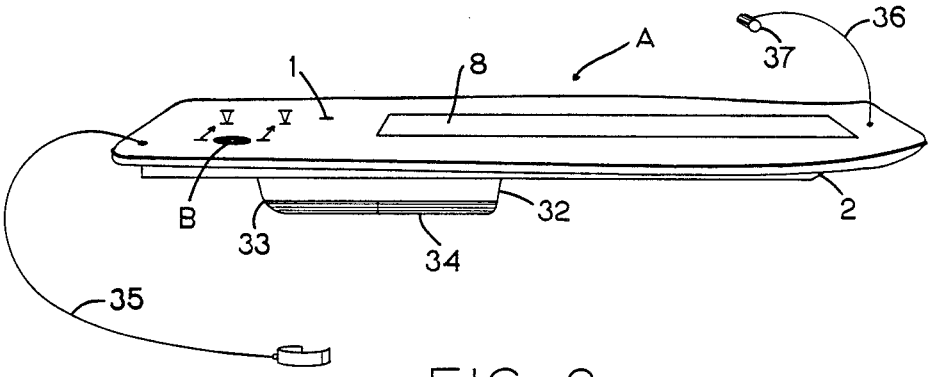
FIG. 2 is a perspective view of the watercraft.

The reference letter A indicates a small watercraft constructed in accordance with an embodiment of the invention. The craft A has a hollow interior formed from a generally flat upper deck 1 and a lower hull 2 joined together at a seam 38 by securing and sealing marginal flanges. The deck 1 and hull 2 are composed of fiberglass reinforced plastic of the type normally used in this art. An engine 3 (FIGS. 3 and 4) is mounted on the bow portion of the hull 2. A jet propulsion unit 5 installed at a rear portion of the hull 2 is adapted to be driven by the engine 3 through a drive shaft 4. A fuel tank 6 and battery 7 are mounted adjacent to the engine 3. Centrally of the watercraft, the deck 1 is provided with an opening that is closed by a removable hatch 8 (FIG. 2). The hatch 8 is removable so as to make the interior of the craft accessible.

Figure 6:
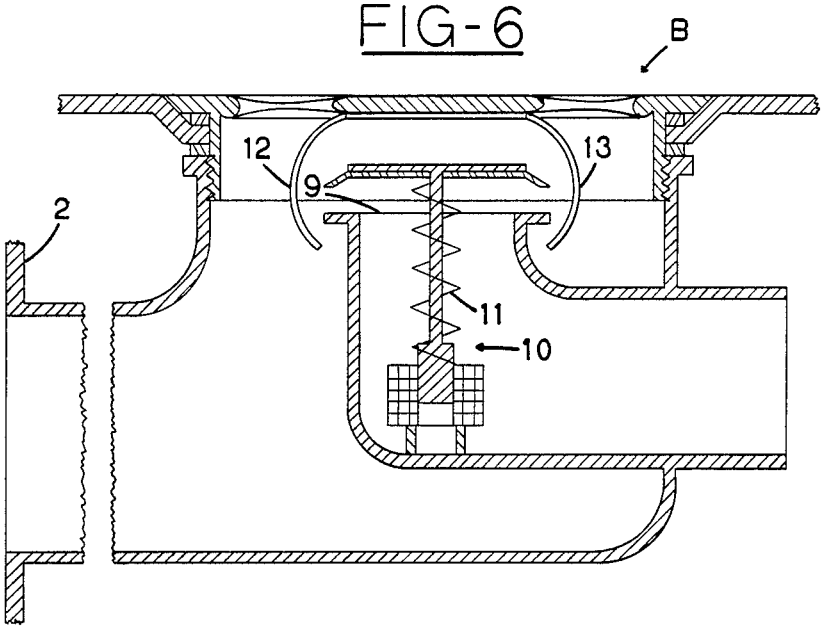
FIG. 6 is a fragmentary cross-sectional view, taken along the line V—V of FIG. 2, of a valve assembly through which air may flow from the ambient atmosphere into the interior of the craft.

An air intake valve assembly B, as may be seen in FIG. 2, is provided at the rear of the rear of the deck 1. The primary object of the valve assembly B is to prevent water from entering the interior of the craft. An enlarged cross-sectional view of the valve assembly B is shown in FIG. 6. An air intake port 9, through which air may flow from the ambient atmosphere into the interior of the craft, is recessed below the surface of the deck 1. A solenoid operated valve 10, which is held in a normally open position by a spring 11, can be closed to seal the intake port 9. The air intake port 9 and valve 10 are surrounded by a plurality of radially arranged electrodes 12, 13 (for clarity, only two electrodes are shown in FIG. 6). If any electrode 12, 13 is electrically shorted to an adjacent electrode by the presence of water, a relay 52 (FIG. 5 only) is energized. This relay 52 then energizes the solenoid valve 10, sealing the air intake port 9 and preventing water from entering the interior of the craft.

While the air intake 9 is sealed the engine 3 does not have access to a supply of air. A substitute for air, consisting of a mixture of nitrous oxide (an oxidizing gas capable of supporting combustion) and exhaust gas, is supplied on demand by means of a gas recycling system. The gas recycling system delivers the nitrous oxide/exhaust mixture to the interior of the craft through a control valve assembly C (FIG. 4).

Referring to FIGS. 4 and 5, the exhaust gas from the engine 3 enters a cooling chamber 14, within which the heat from the exhaust is transferred to water circulating through the chamber 14. The cooling water supply is conventional and not illustrated. The rate of flow of the cooling water is controlled by a thermostatic valve (not shown), which results in a uniform exhaust temperature at the outlet of the cooling chamber 14. The cooled exhaust gas then enters the control valve assembly C through an exhaust gas conduit 15. An additional exhaust tube 16 connects the control valve C to a conventional water trap 17. The water trap 17 prevents water from entering the exhaust system while the engine is not running. The exhaust the leads from the water trap 17 to the exterior of the craft through an opening in the hull 2.

A nitrous oxide tank 19 (FIGS. 4 and 5), mounted on a central portion of the hull 2, has attached to it a regulable pressure reducer (slave regulator) 20, which drops the tank outlet pressure by approximately 90%. The pressure reducer 20 is further connected to the exhaust gas conduit 15 through a hose 31. The outlet pressure of the pressure reducer 20 varies proportionally with the pressure in the exhaust gas conduit 15. A small orifice 39 (FIG. 5 only) is placed at an intermediate position within the hose 31. The function of the orifice 39 is to greatly restrict the rate of flow of gas through the hose 31, thereby limiting the influence of the rapid pressure fluctuations present in the exhaust gas conduit 15.

The reduced pressure nitrous oxide leads from the outlet of the pressure reducer 20 to the cooling chamber 14 through a hose 53. The nitrous oxide exits the cooling chamber 14 at a constant temperature. From the cooling chamber 14 the nitrous oxide leads to the control valve assembly C through an additional tube 21.

In addition to its use in the recycling system, the nitrous oxide can also be employed to boost the power output of the engine 3. This may be accomplished in a conventional manner and therefore is not illustrated here.

A sealed air reservoir tank 22, mounted on a forward portion of the hull 2, is also connected to the control valve assembly C, through a tube 23. This reservoir tank 22 is sealed by closing a stopcock valve (not shown) prior to operating the craft, thus trapping atmospheric pressure within. In this instance, the stopcock valve is mounted on the same shaft as the ingnition switch (also not shown).

Figure 7:
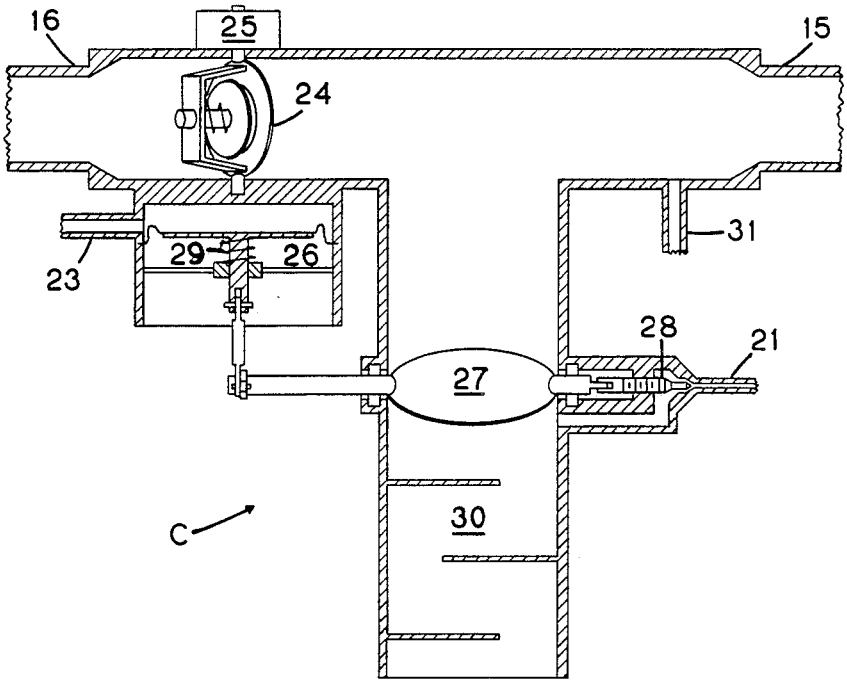
FIG. 7 is an cross-sectional view of a valve assembly which, on demand, can supply a nitrous oxide/exhaust mixture to the interior of the craft.

FIG. 7 is an enlarged sectional view of the control valve assembly C. A rotatably mounted, spring-loaded check valve 24 is mechanically connected to an electric motor 25. The check valve 24 is held in a normally open position (that is, its disk is held in a position parallel to the flow of exhaust gas) by a torsion spring (not shown). When the solenoid valve 10 is energized by the relay 52, the electric motor is simultaneously energized, rotating the check valve 24 to a closed position. This produces an elevated exhaust gas pressure upstream of the check valve 24.

The principle of operation of the control valve assembly C is identical to that of a conventional self-actuated control valve, which are commonly known as regulators. A diaphragm 26 is mechanically connected to a butterfly valve 27 and a needle valve 28. The needle and seat of the needle valve 28 are machined to produce throttling characteristics similar to that of the butterfly valve 27. The diaphragm 26 is exposed on one side to the pressure within the sealed air chamber 22 (atmospheric pressure), and on the other side to the pressure within the interior of the craft. A light spring 29 holds the valves 27, 28 in a normally closed position. When the solenoid valve 10 is closed, sealing the air intake port 9, the engine 3 begins to produce a partial vacuum within the interior of the craft. This causes the diaphragm 26 to move out, opening the butterfly 27 and needle valve 28. The opening butterfly valve 27 admits exhaust gas, while the opening needle valve 28 admits nitrous oxide. The two gases pass through a mixing chamber 30 and then out into the interior of the craft. The two valves 27, 28 continue to open until the pressure is equalized on both sides of the diaphragm 26.

Figure 3:
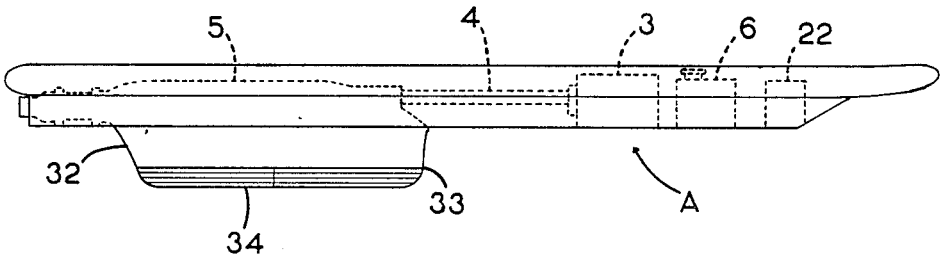
FIG. 3 is a side elevational view.

As previously indicated, the craft is equipped with a water-jet propulsion unit 5. Referring to FIG. 3, water is delivered to the jet propulsion unit 5 through a narrow, elongated, hollow downward extension 32 of the hull 2. The hollow extension 32 has a water intake opening 33 at its terminus. This opening 33 is covered with an aluminum grating 34 to obstruct the entrance of weeds or other foreign objects into the jet propulsion unit 5. The primary function of the extension 32 is to minimize the occurrence of a loss of forward thrust which may occur if the craft is vertically displaced above the surface of the water.

The craft is also furnished with a flexible cord 35 (FIG. 2), attached to a rear portion of the deck 1. The cord 35 can be fastened to the operator's ankle. The sole purpose of the cord 35 is to allow the operator to easily retrieve the craft if he or she is inadvertently displaced therefrom.

In addition, an adjustable length remote control cable 36, with attached handle 37, extends from a forward portion of the deck 1. The craft's speed and direction are controlled through this cable 36 in a conventional manner. The operator can also steer the craft by shifting his or her weight to the side of the desired direction.

In an additional embodiment of the invention, the exhaust gas alone functions as a substitute for air. As can be seen in FIG. 8, the craft incorporates two air intake valve assemblies E and F, similar to those of the previous embodiment. The forward air intake assembly F has an extended outlet tube 45 with an electric blower assembly 46 mounted in the tube 45. The blower 46 forces air from the ambient atmosphere to a forward portion of the interior of the craft. Whereas air exits the interior of the craft through the rear valve assembly E, as indicated by the arrows.

Referring to FIGS. 8 and 9, the exhaust gas from the engine 3 enters a cooling chamber 40. The cooled exhaust then enters a control valve assembly D through an exhaust gas conduit 41. From the control valve D the exhaust then leads to the exterior of the craft as before.

A sealed air reservoir tank 42, identical in structure and function to the air reservoir 22 of the previous embodiment, is also connected to the control valve D through a tube 43.

FIG. 9 is an enlarged sectional view of the control valve assembly D. A rotatably mounted, spring-loaded check valve 44 is held in a normally open position by a torsion spring (not shown). When the valve assemblies E and F close, the check valve 44 simultaneously closes, producing an elevated exhaust gas pressure upstream of the check valve 44, in the same manner as before.

While the air valve assemblies E and F are closed the engine 3 does not have access to a supply of air and the exhaust gas acts as a substitute. The exhaust gas enters the rear of the interior of the craft through a supply regulator whose elements include a butterfly valve 48 and a diaphragm 49 mechanically connected to the butterfly valve 48. A light spring 50 holds the butterfly valve 48 in a normally closed position. The diaphragm 49 is exposed on one side to the pressure within the sealed air chamber 42 (atmospheric) and on the other side to the pressure within the interior of the craft. When the air valve assemblies E and F close, the engine 3 begins to produce a partial vacuum in the interior of the craft. This causes the diaphragm 49 to move out, opening the butterfly valve 48 and admitting exhaust gas in the stern of the craft. The engine intake 51 is located in the bow of the craft. This allows the engine 3 to operate for a limited amount of time by using the existing air in the craft's interior. When the air valve assemblies E and F reopen, the blower 46 quickly displaces any exhaust which was previously introduced into the interior.

What is claimed is:

1. A surfboard-sized watercraft comprising:

a deck and a hull joined together to form a hollow interior;

an engine mounted on a bow portion of said hull, said engine having a gas intake in communication with said interior and an exhaust gas outlet;

a fuel tank and a battery mounted on said hull;

a propulsion means disposed in a stern portion of the watercraft and drivingly connected to said engine;

a valved air intake port, formed in said deck, for taking air into said interior, including means for closing said valve;

a means for delivering an air substitute to said interior while said air intake port is closed.

2. A surfboard-sized watercraft as set forth in claim 1 wherein said propulsion means comprises of a water jet propulsion device including:

a water intake port for said water jet at the terminus of a narrow, elongated, hollow downward extension of said hull.

3. A surfboard-sized watercraft as set forth in claim 1 wherein said air substitute delivery means includes:

an exhaust gas conduit connected to said exhaust gas outlet and having a pressure elevation means therein maintaining said exhaust gas in said conduit at a pressure greater than atmospheric pressure;

a supply regulator, whose inlet is connected to said exhaust gas conduit and whose outlet is in communication with said interior, for controlling the volume of recycled exhaust gas delivered to said interior;

an air reservoir connected to said supply regulator, for adjusting the output pressure of said supply regulator.

4. A surfboard-sized watercraft as set forth in claim 3 wherein said exhaust gas outlet includes a means for cooling said exhaust gas.

5. A surfboard-sized watercraft as set forth in claim 1 wherein said air substitute delivery means includes:

an exhaust gas conduit connected to said exhaust gas outlet and having a pressure elevation means therein maintaining said exhaust gas in said conduit at a pressure greater than atmospheric pressure;

a supply regulator, whose inlet is connected to said exhaust gas conduit and whose outlet is in communication with said interior, for controlling the volume of recycled exhaust delivered via a mixing chamber to said interior;

a source of oxidizing gas connected by an oxidizing gas tube to said supply regulator, with a regulable pressure reducer interposed in said oxidizing gas tube, said supply regulator controlling the volume of said oxidizing gas delivered via said mixing chamber to said interior, whereby said supply regulator automatically delivers the oxidizing and recycle exhaust gases to the interior, as demanded by the engine, while said air intake valve is closed.

6. A surfboard-sized watercraft as set forth in claim 5 wherein said exhaust gas outlet includes a means for cooling said exhaust gas.

7. A surfboard-sized watercraft as set forth in claim 5 wherein said regulable pressure reducer is connected through a proportioning hose to said exhaust gas conduit, said proportioning hose having a restricting orifice disposed within, whereby the output pressure of said regulable pressure reducer varies proportionally to the pressure within said exhaust gas conduit.

* * * * *